United States Patent [19]

Infeld

[11] Patent Number: 4,854,213

[45] Date of Patent: Aug. 8, 1989

[54] MUSIC STRING

[75] Inventor: Peter Infeld, Vienna, Austria

[73] Assignee: Dr. Thomastik und Mitarbeiter Offene Handelsgesellschaft, Vienna, Austria

[21] Appl. No.: 291,686

[22] Filed: Dec. 29, 1988

[30] Foreign Application Priority Data

Feb. 26, 1988 [AT] Austria ..... A500/88

[51] Int. Cl.[4] ..... G10D 3/10

[52] U.S. Cl. ..... 84/297 S; 84/199

[58] Field of Search ..... 84/199, 297 S

[56] References Cited

U.S. PATENT DOCUMENTS

| | | | |
|---|---|---|---|
| 3,120,144 | 2/1964 | Bayer | 84/199 |
| 4,016,714 | 4/1977 | Crandall et al. | 57/242 X |
| 4,120,146 | 10/1978 | Robin | 57/162 |
| 4,365,534 | 12/1982 | Rendell | 84/297 S |

FOREIGN PATENT DOCUMENTS

| | | | |
|---|---|---|---|
| 3709636 | 11/1987 | Fed. Rep. of Germany | 84/297 S |

*Primary Examiner*—Lawrence R. Franklin
*Attorney, Agent, or Firm*—Herbert Dubno

[57] ABSTRACT

A music string consisting essentially of a core composed of aramide fibers and a wound sheath on the core.

3 Claims, 1 Drawing Sheet

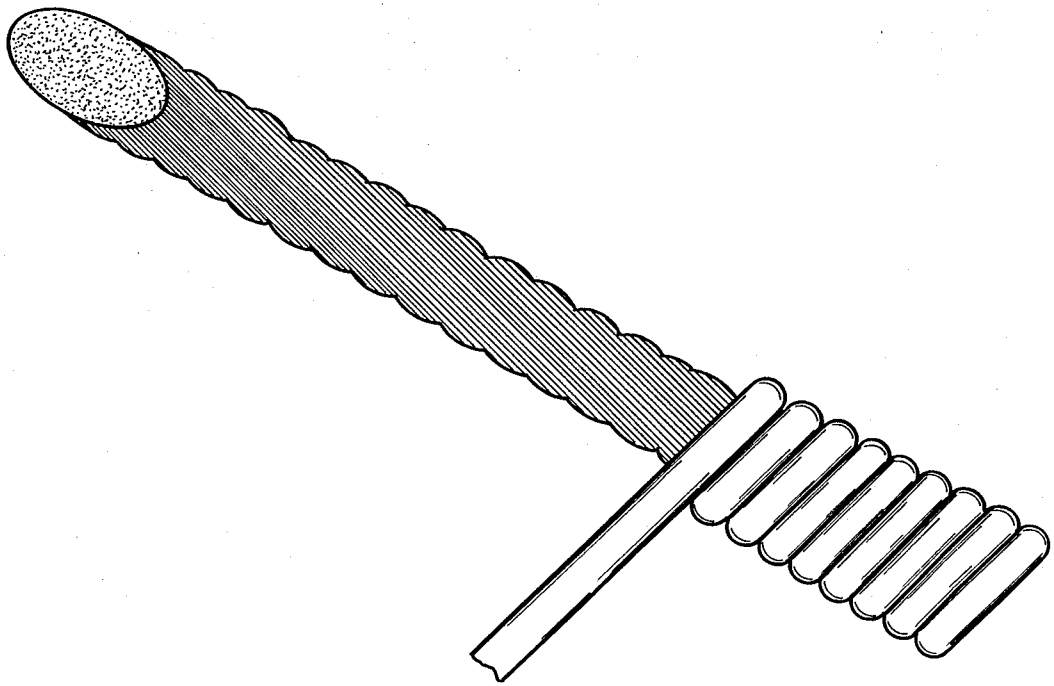

MUSIC STRING

FIELD OF THE INVENTION

My present invention relates to a music string and, more particularly, to a music string for guitars and like strumming instruments and for plucking percussive instruments such as harpsichords or pianos, and even for bowed instruments such as instruments of the violin family, of the type having a core and a wound sheath surrounding the core.

BACKGROUND OF THE INVENTION

It is known to provide music strings for the aforedescribed purposes which are composed of a core and a sheath formed by a coil tightly surrounding the core. This basic frequency of each such string for a given tension and free oscillation length is a function of the weight per unit length of the string.

With prior art strings having a sheath in the form of a strand which encircles the core, this weight per unit length can be contributed in part by the core of the string and, in part, by the sheath or strand which is spun around the core and which serves to determine the musical tonality of the string by the nature of its material. It is desirable to allow the sheath as much as possible to modulate the acoustical tonality of the string. For certain long, thin strings, the musical tonality in the past could not be modulated effectively or a predetermined musical tonality could not be obtained, because the resulting thin core would tear. In the latter case, musical strings could not be effectively constructed.

OBJECTS OF THE INVENTION

It is the principal object of this invention to provide an improved musical string whereby this drawback is eliminated.

A more specific object of this invention is to provide a musical string of high tensile strength, but low weight per unit length so that the modulation of the musical tonality to obtain specific tonalities utilizing the wound sheath as described is possible even for relatively thin musical strings.

Another object of this invention is to provide an improved musical string of high strength, relatively thin construction and a musical tonality determined substantially exclusively by the wound sheath applied to the core.

SUMMARY OF THE INVENTION

These objects and others which will become more readily apparent hereinafter are attained, in accordance with the invention, by providing the core material in the form of aramide fibers. I have found, surprisingly, that aramide fibers, because of their high specific strength, high modulus of elasticity, low ductility and elongation, high hardness and high notch impact strength and low water pickup can be used to make especially thin cores so that the musical tonality is determined substantially exclusively by the wound sheath therearound.

The invention is most applicable to thin or high-octave guitar strings and other strumming strings and for such strings, I have found that the wire wound bout the core to form the sheath should preferably be silver which provides a good musical tonality and has a relatively high mass per unit length. Of course, other winding wires may be used as well.

I prefer to make use of the aramide filament yarn which is marketed by Du Pont under the Trademark Kevlar 49 and having the following physical properties:

| | |
|---|---|
| Tensile Strength (MPa) | 2,760 |
| Maximum Tension Force (cN/tex) | 190 |
| Modulus (MPa) | 120,000 |
| Modulus (cN/tex) | 8,300 |
| Elongation to Break (%) | 1.9 |

The aramides which are used are polyamides with aromatic groups forming the polymer chains and of which at least 85 weight percent is constituted by amide groups linked in linear macromolecules and up to 50 percent of the amide bonds can be replaced by imide bonds.

Suitable aramides are those represented below:

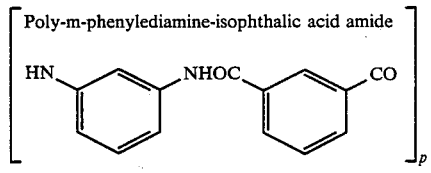

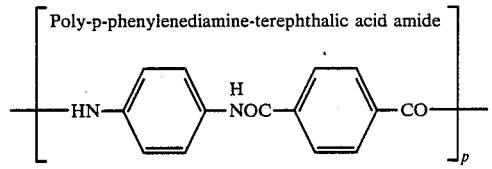

where p represents the number of metaphenylenediamine-isophthalic acid amide or para-phenylenediamineterephthalic acid amide molecules linked together.

While polyamides have been proposed as core materials in music strings, the polyamides which have been used do not resemble the aramide fibers with respect to their chemical or physical properties and, indeed, it may well be the fact that aramide fibers were avoided because it was to be expected that they would have oscillation damping properties. Surprisingly, in the context of sheath music strings, they have been found to be highly effective as core materials in situations in which the musical tonality is determined primarily or exclusively by the sheath winding.

Indeed, it is all the more surprising that in spite of the fact that aramide materials have been available since the 1960s under a variety of commercial names, they have not been used in the fabrication of music strings heretofore.

BRIEF DESCRIPTION OF THE DRAWING

The above objects, features and advantages of my invention will become more readily apparent from the following description, reference being made to the accompanying drawing, the sole FIGURE of which is a fragmentary perspective view, with a portion of the sheath removed, of a music string embodying the principles of this invention.

SPECIFIC DESCRIPTION

A guitar string is formed as shown at 10 with an aramide filament core 11 consisting of the Kevlar 49 filaments 12 surrounded by a wound silver wire sheath 13. The aramide filament core had the properties described above.

I claim:

1. A musical string consisting of a core composed of aramide fibers and a wound sheath on a core, wherein said sheath is composed of a metal wire.

2. The music string defined in claim 1 wherein said core has the following properties:

| | |
|---|---|
| Tensile Strength (MPa) | 2,760 |
| Maximum Tension Force (cN/tex) | 190 |
| Modulus (MPa) | 120,000 |
| Modulus (cN/tex) | 8,300 |
| Elongation to Break (%) | 1.9. |

3. The music string defined in claim 1 wherein said metal wire is a silver wire.

* * * * *